US005722506A

United States Patent [19]

Takai

[11] Patent Number: 5,722,506

[45] Date of Patent: Mar. 3, 1998

[54] MOVABLE WORKING PLATFORM

[75] Inventor: Ishiyuki Takai, Tokyo, Japan

[73] Assignee: Sanritsu Giken Kogyo Kabushiki-Kaisha, Tokyo, Japan

[21] Appl. No.: 317,369

[22] Filed: Oct. 4, 1994

[30] Foreign Application Priority Data

Oct. 4, 1993 [JP] Japan ..... 5-271305

[51] Int. Cl.[6] ..... E04G 3/16

[52] U.S. Cl. ..... 182/16; 182/13; 182/63

[58] Field of Search ..... 182/16, 129, 63, 182/13; 280/243, 244, 246, 247, 251, 11.115

[56] References Cited

U.S. PATENT DOCUMENTS

| | | | |
|---|---|---|---|
| 1,529,012 | 3/1925 | Crawford | 280/243 X |
| 2,380,160 | 7/1945 | Fieroh | 182/13 |
| 2,573,575 | 10/1951 | Keroson | 182/16 X |
| 3,180,450 | 4/1965 | Crager et al. | 182/16 X |
| 3,232,375 | 2/1966 | Warthen | 182/13 |
| 3,256,954 | 6/1966 | Warthen | 182/16 X |
| 3,276,542 | 10/1966 | Dommier | 182/16 |
| 3,429,398 | 2/1969 | Raynolds et al. | 182/13 |
| 3,485,509 | 12/1969 | Searle | 280/243 |
| 3,520,382 | 7/1970 | Halsey et al. | 182/16 X |
| 4,053,025 | 10/1977 | Slusarenko | 182/16 X |
| 4,088,202 | 5/1978 | Costello | 182/13 |

FOREIGN PATENT DOCUMENTS

| | | | |
|---|---|---|---|
| 447268 | 10/1912 | France | 280/243 |
| 1242812 | 8/1960 | France | 182/13 |
| 1366222 | 6/1964 | France | 182/13 |
| 2592355 | 7/1987 | France . | |
| 1965730 | 7/1971 | Germany | 182/13 |

OTHER PUBLICATIONS

ESCA 2000 Pilotez Votre Echafaudage, 2 page Brochure.

*Primary Examiner*—Leslie A. Braun
*Assistant Examiner*—Richard M. Smith

[57] ABSTRACT

A movable working platform comprises a scaffold including a front frame having a pair of support posts, and a pair of front wheels mounted on opposite sides of a lower end of the front frame, a rear frame having a pair of support posts, and a pair of rear wheels mounted on opposite sides of a lower end of the rear frame. A scaffolding platform is disposed between the front and rear. A steering mechanism of the platform includes a steering shaft vertically arranged along the front frame, a handle mounted on an upper end of the steering shaft, and a drive wheel mounted on a lower end of the steering shaft. A drive mechanism of the platform includes a pedal swingably supported by the front frame, a wire member wound on a pulley and reciprocally moved in response to a swinging motion of the pedal, and a one-way clutch for transmitting only a one-way rotation of the pulley to the drive wheel.

23 Claims, 6 Drawing Sheets

MOVABLE WORKING PLATFORM

BACKGROUND OF THE INVENTION

1. Field of the Invention

This invention relates to a movable working platform which can be moved by power of a worker riding thereon, in order to perform such work as construction and repair of wall and ceiling of various kinds of buildings, cleaning of window glass, inspection of goods in warehouse and book shelves, delivery of goods in and out of warehouse, etc.

2. Brief Description of the Prior Art

As for a movable working platform in which a pair of front wheels and a pair of rear wheels are attached to a scaffold having a framework structure and in which the front wheels can be moved up and down and steered, and which can be moved in an optional direction through operation of the front wheels by the worker on the scaffold, one employing a front wheel lock system disclosed in French Patent No. 2,592,355 is already put into actual practice and known.

As is schematically shown in FIG. 8, this known movable working platform comprises height-adjustable front and rear frames 201 and 202 connected to each other, a height-adjustable drive shaft 203 movably and rotatably arranged along the front frame 201 for movement up and down, a pair of front wheels 204 and 205 supported by a lower end of the drive shaft 203, a pair of rear wheels 206 and 206 supported by a lower end of the rear frame 202, a pedal 207 mounted on an intermediate portion of the drive shaft 203, and a handle 208 attached to an upper end of the drive shaft 203.

A worker on the scaffolding platform 209 turns the handle 208 counterclockwise, when viewed from the top in FIG. 8, by approximately 90 degrees with the foot away from the pedal 207, so that the right front wheel 204 is moved to a position indicated by ① about the left front wheel 205. Then, the worker turns the handle 208 clockwise by approximately 90 degrees, so that the left front wheel 205 is moved to a position indicated by ② about the right front wheel 204. By repeating the above operation, the front wheels 204 and 205 are alternately moved forwardly as indicated by ③ and ④, and eventually, the overall scaffold is moved forwardly. If the handle 208 is operated such that the leftward turning angle and the rightward turning angle of the handle 208 are generally equal to each other, the scaffold moves generally straight ahead though by somewhat zigzag course. If the handle 208 is operated such that the turning angle is small in one direction, the scaffold makes a turn in that direction.

Lower ends of the front frame 201 form a pair of front legs 210 which are in contact with a floor surface at locations outside the front wheels 204 and 205.

In order not to disturb the movement of the scaffold by the front legs 210 and the front wheels 204 and 205 being pressed against the floor surface with strong force when the handle 208 is operated to move the scaffold, it is necessary for the worker to place his/her weight backwardly so that the weight is supported chiefly by the rear wheels 206 and 206, preferably allowing the front legs 210 to be slightly floated or raised.

The trouble is that since a rather large force must be applied to the handle 208 in order to alternately turn the handle 208 in opposite directions to move the scaffold, the worker on the scaffolding platform is obliged to keep a somewhat forwardly-inclined attitude. Therefore, the worker is compelled to keep such an unnatural attitude on the scaffolding platform that he/she inclines forwardly while trying to place the weight backwardly. Moreover, since the worker operates the handle 208 in that attitude, much labor is required for the movement of the scaffold, with the result that the worker is liable to become tired. It is practically impossible to move the scaffold in such a significantly increased state of load that the scaffolding platform is loaded with other loads and/or other workers.

SUMMARY OF THE INVENTION

It is, therefore, an object of the present invention to provide a movable working scaffold in which a worker can move the scaffold with a reduced force and is, therefore, not easily tired.

Another object of the present invention is to provide a movable working scaffold in which a worker can move the scaffold even when it is loaded with other loads and/or other workers.

A further object of the present invention is to provide a movable working scaffold in which a worker can smoothly perform a work at a high position while moving the scaffold.

To achieve the above objects, there is essentially provided a movable working platform comprising a scaffold including a front frame having a pair of support posts, and a pair of front wheels mounted on opposite sides of a lower end of the front frame, a rear frame having a pair of support posts, and a pair of rear wheels mounted on opposite sides of a lower end of the rear frame, and a scaffolding platform disposed between the front and rear frames, a steering mechanism including a steering shaft vertically arranged along the front frame, a handle mounted on an upper end of the steering shaft, and a drive wheel mounted on a lower end of the steering shaft, and a drive mechanism including a pedal swingably supported by the front frame, a wire member wound on a pulley and reciprocally moved in response to a swinging motion of the pedal, and a one-way clutch for transmitting only a one-way rotation of the pulley to the drive wheel.

The movable working platform may further comprise a scaffold stationarily holding mechanism including a stepping member vertically movably arranged along the front frame, and means for fixing the stepping member at a desired height.

The movable working platform may further comprise means for adjusting a vertical mounting position of the scaffolding platform between the front and rear frames, and means for adjusting a vertical mounting position of the pedal.

The steering mechanism may include a front wheel raising mechanism for lowering the drive wheel so as to retain the drive wheel in a lower position than the front wheels.

The movable working platform may further comprise a rear wheel braking mechanism including a braking lever mounted on the scaffold, a shoe to be contacted, under pressure, with a ring face formed on each of the rear wheels, and a wire extending along the scaffold and adapted to operatively connect the braking lever to the shoe.

The steering mechanism may include a drive wheel raising mechanism for lifting up the drive wheel so as to retain the drive wheel in a higher position than the front wheels.

When the worker on the scaffolding platform steps on the pedal repeatedly, the pulley is reciprocally rotated by the wire member and the drive wheel is intermittently rotated in only a forward direction by the one-way clutch so that the scaffold is moved forwardly. When the handle is turned, the direction of the drive wheel is changed to turn the scaffold.

Namely, the scaffold can be moved in any desired direction by only the leg force for stepping on the pedal and without a need of much labor. Since the scaffold is supported by four wheels (a pair of front wheels plus a pair of rear wheels), it is stable.

Furthermore, the scaffold stationarily holding mechanism prevents the scaffold in a stopped state from moving accidentally. Since the mounting positions of the scaffolding platform and the pedal can be adjusted in the sense of height, the workable range or area is increased. The front wheel raising mechanism makes it possible for the scaffold to move smoothly on an upward slope, the rear wheel braking mechanism increases the safety of movement on a downward slope, and the drive wheel raising mechanism ensures a smooth movement of the scaffold when the worker moves the scaffold by pushing, without riding on the scaffold.

The novel features which are considered characteristic of this invention are set out in the appended claims. The invention itself, however, together with additional objects and advantages thereof will be best understood from the following detailed description taken in conjunction with the accompanying drawings which illustrate, by way of example only, several preferred embodiments of this invention.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DETAILED DESCRIPTION OF THE EMBODIMENT

Figure 1:
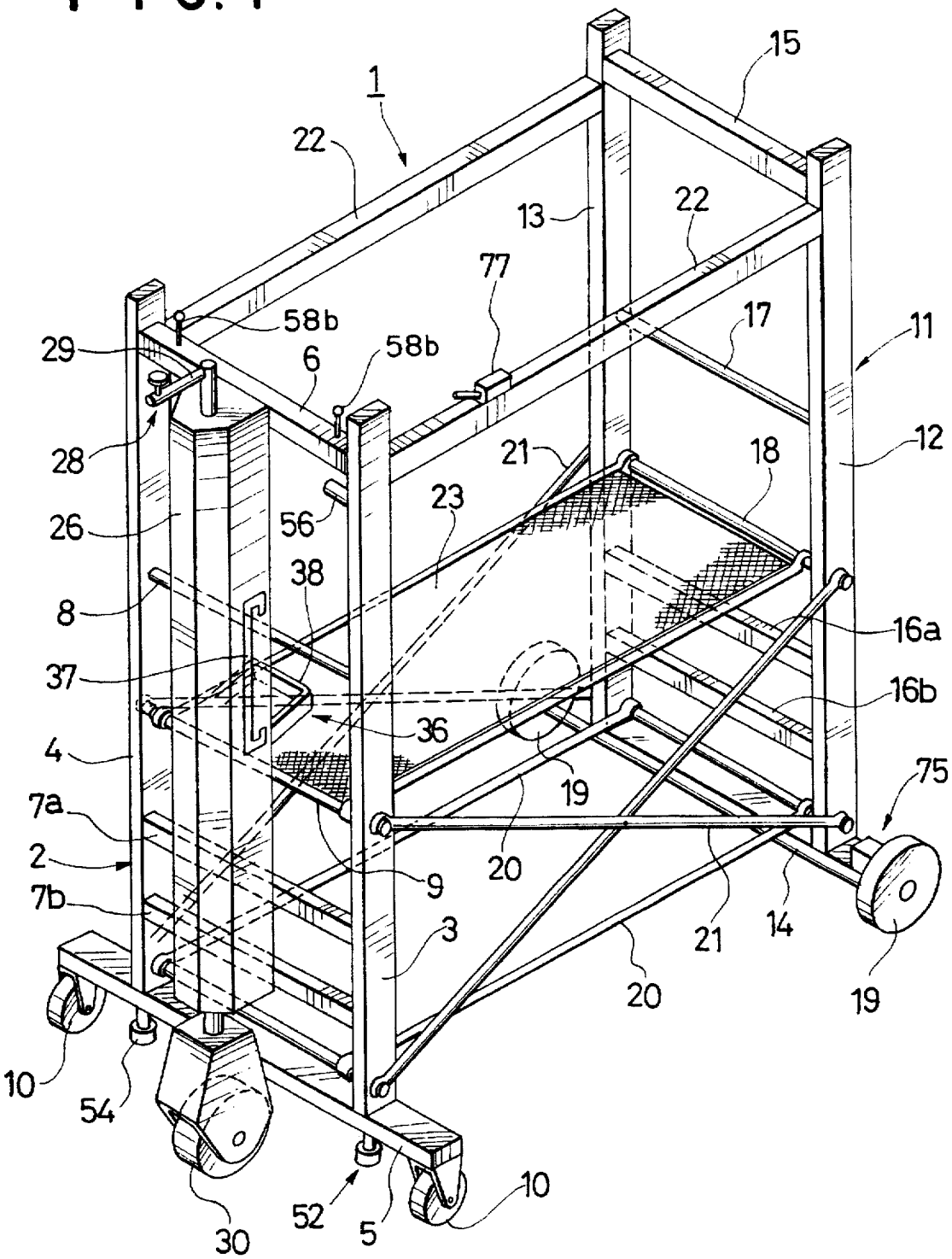
FIG. 1 is a perspective view of a movable working platform according to one embodiment of the present invention.

Several preferred embodiments of the present invention will be described with reference to the accompanying drawings. In FIG. 1 which shows an overall picture of a movable working platform, a front frame 2 and a rear frame 11 comprise, respectively, a pair of vertically extending parallel support posts 3 and 4, 12 and 13, lower crossbeam members 5 and 14 fixed respectively to lower ends of the support posts with opposite ends of the lower crossbeam members allowed to project sideways, upper crossbeam members 6 and 15 fixed at opposite ends thereof respectively to upper ends of the support posts, a pair of upper and lower crosspiece members 7*a* and 7*b*, 16*a* and 16*b* transversely extending respectively between generally lower end portions of the support posts 3 and 4, and between generally lower end portions of the support posts 12 and 13, and a pair of upper and lower receiving crosspiece members 8 and 9, 17 and 18 likewise transversely extending respectively between the support posts 3 and 4, and between the support posts 12 and 13 but at locations above the crosspiece members 7*a*, 7*b*, 16*a* and 16*b*. A pair of front wheels 10, 10 and a pair of rear wheels 19, 19 are attached respectively to opposite ends of the respective lower crossbeam members 5 and 14. Particularly, the front wheels 10, 10 are casters which are turnable. It should be noted that opposite ends of the crosspiece members 7*a*, 7*b*, 16*a* and 16*b* and opposite ends of the receiving crosspiece members 8, 9, 17 and 18 are also fixed to the support posts 3, 4, 12 and 13, respectively.

The front frame 2 and the rear frame 11 are connected by a pair of auxiliary crosspiece members 20 removably disposed respectively between lower ends of the front and rear support posts 3 and 12, 4 and 13, a pair of diagonal beams 21 disposed respectively between generally lower end portions of the front and rear support posts 3 and 12, 4 and 13, and a pair of hand rails 22 disposed respectively between upper ends of the front and rear support posts 3 and 12, 4 and 13. A flat scaffolding platform 23 having hooks 24 at opposite sides of front and rear ends thereof is horizontally disposed between the front frame 2 and the rear frame 11 by hanging the hooks 24 on either upper or lower receiving crosspiece members 8 and 17 or 9 and 18. The front and rear frames 2 and 11, and the scaffolding platform 23 disposed therebetween constitute a scaffold 1.

Figure 2:
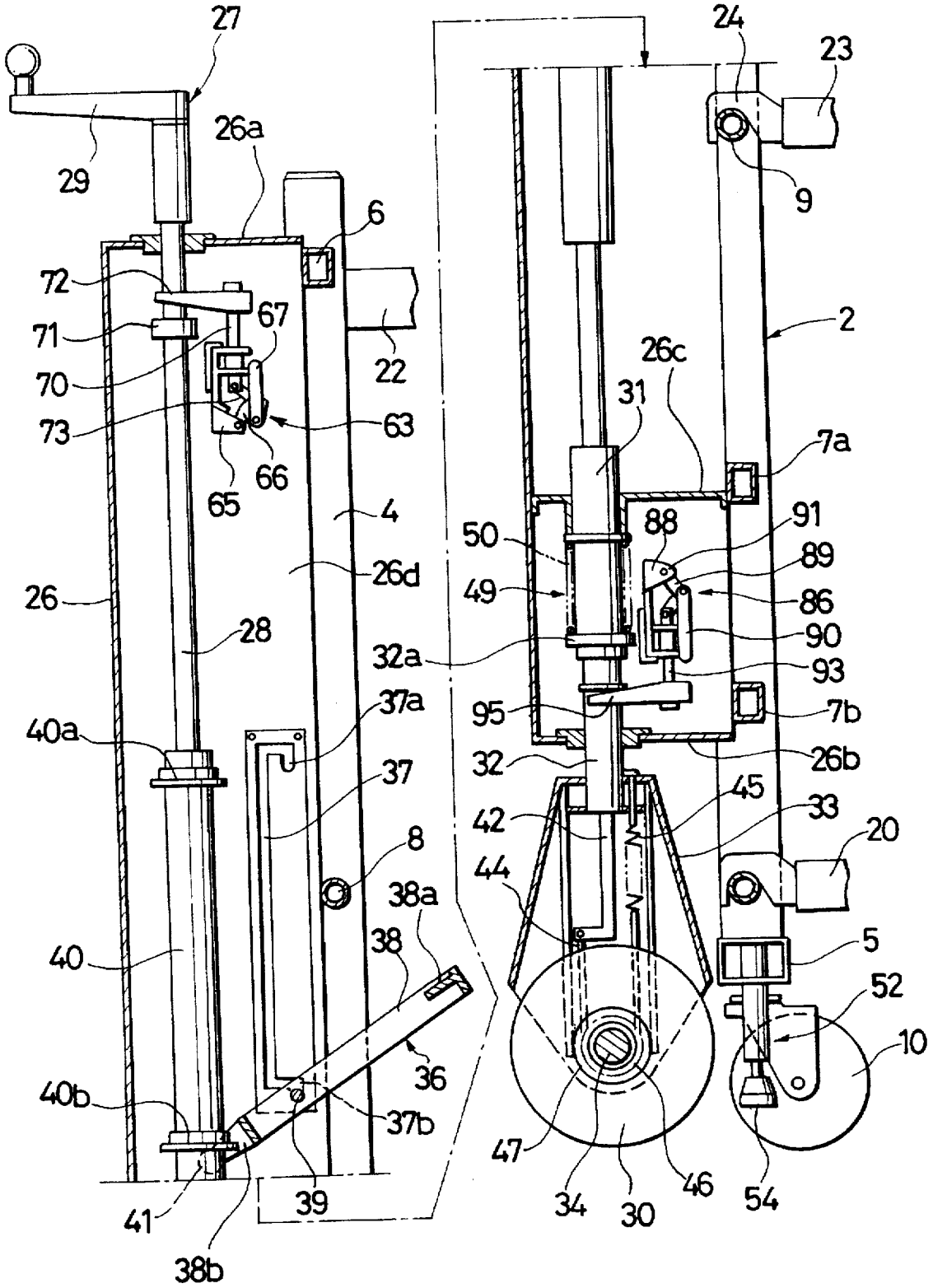
FIG. 2 is an enlarged partly vertically sectional view of FIG. 1.

At a central front of the front frame 2, a vertically extending cover member 26 is removably fixed to the upper crossbeam member 6, and the crosspiece members 7*a* and 7*b*. Referring chiefly to FIG. 2, a pivot shaft 28 formed of a pipe member is allowed to extend vertically through an upper lid plate 26*a* and a lower lid plate 26*b* of the cover member 26. A handle 29 is firmly attached to an upper end of the pivot shaft 28 which upper end projects upwardly of the upper lid plate 26*a*, and a drive wheel 30 is mounted on a lower end of the lower lid plate 26*b* which lower end projects downwardly of the lower lid plate 26*b*. These component parts constitute a steering mechanism 27 of the scaffold 1.

More specifically, an upper end portion of the pivot shaft 28 is rotatably supported directly by the upper lid plate 26*a*, and a lower end portion thereof is rotatably supported by a guide sleeve 31 firmly attached to an intermediate lid plate 26*c*. That part of the pivot shaft 28, which further extends downwardly through the guide sleeve 31, is fixedly fitted in a holding sleeve 32 rotatably supported by the lower lid plate 26*b*, so that it rotates in unison with the holding sleeve 32. A bearing base 33 extending downwardly of the holding sleeve 32 is firmly attached to the holding sleeve 32. A drive shaft 34 with the drive wheel 30 firmly attached thereto is rotatably supported on the bearing base 33.

The handle 29 and the drive wheel 30 are arranged on the pivot shaft 28 at a same phase. The arrangement being such that when the handle 29 is turned to face forwardly or backwardly, the scaffold 1 proceeds forwardly or backwardly. By properly turning the handle 29, the direction of the drive wheel 30 is changed and therefore, the scaffold 1 makes a turn depending of the handle's angle of turn. In this embodiment, since the front wheels 10 are casters, they freely change the direction following the drive wheel 30, thus making it easy for the scaffold 1 to turn.

A drive mechanism 36 for rotating the drive wheel 30 in order for a worker on the scaffolding platform 23 to self-propel the scaffold 1 is provided along the steering mechanism 27.

Figure 3:
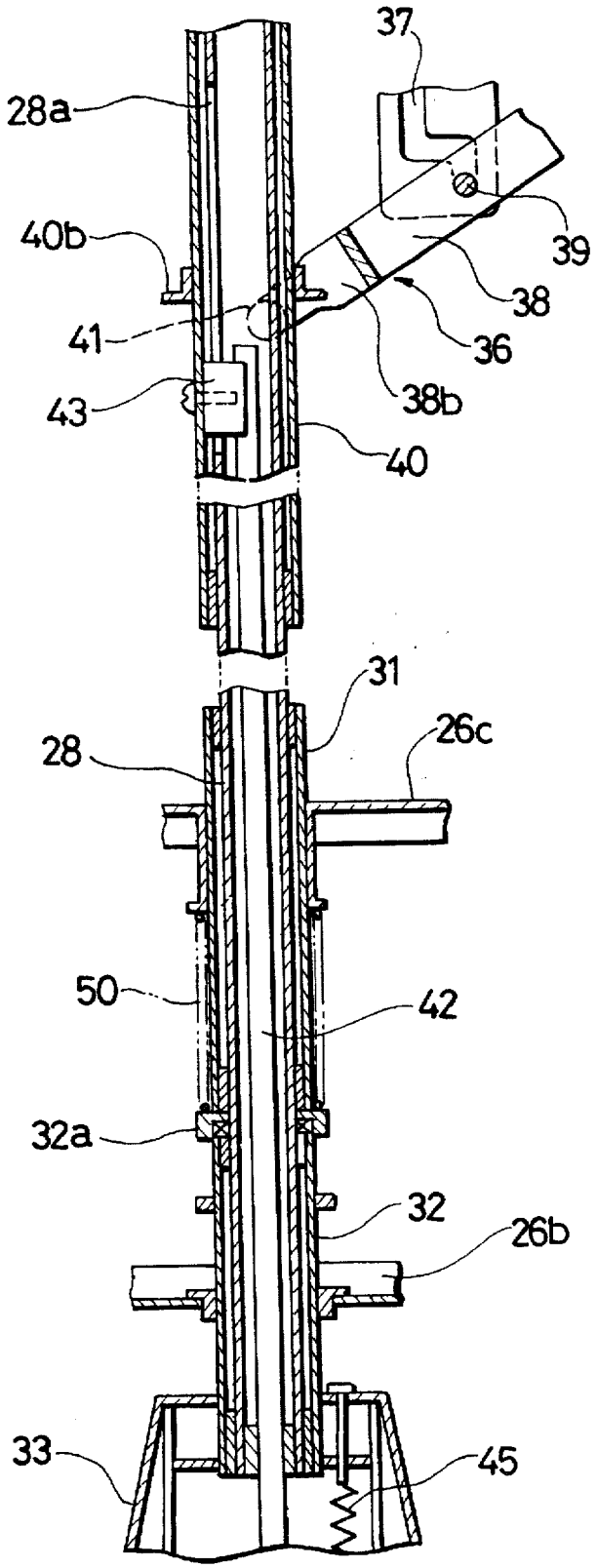
FIG. 3 is a partly vertically sectional view showing chiefly a drive mechanism.

Namely, with reference chiefly to FIGS. 2 and 3, vertically extending guide grooves 37 having a length equal to the distance between the upper and lower receiving crosspiece members 8 and 9 for locking the scaffolding platform 23 are formed in side plates 26*d*, respectively, of the cover member 26 which is mounted on the front frame 2. Each of the guide grooves 37 is provided on opposite ends thereof with L-shaped lock grooves 37*a* and 37*b* which are bent first backwardly and then downwardly. Opposite ends of a support shaft 39 of a pedal 38 are fitted in the lock grooves 37*a* and 37*b*, respectively. In the illustrations, the scaffolding platform 23 is disposed between the lower receiving crosspiece members 9 and 18, and the support shaft 39 is fitted in the lower lock groove 37*b*. In a case where the scaffolding platform 23 is disposed between the upper receiving crosspiece members 8 and 17, the support shaft 39 is moved along the guide groove 37 and fitted in the upper lock groove 37*a*. Owing to this arrangement, the scaffolding platform 23 and the pedal 38 can be normally held in a positional relationship in the sense of height and the worker on the scaffolding platform 23 can step on the foot-step portion 38*a* of the pedal 38 without keeping an unnatural posture.

On the other hand, a transmission sleeve 40 having flange-like receiving edges 40*a* and 40*b* vertically arranged at the same distance as the upper and lower receiving crosspiece members 8 and 9 is vertically movably mounted on the pivot shaft 28. Rollers 41, which are mounted respectively to two arm pieces 38*b* extending opposite direction to the foot-step portion 38*a* with the support shaft 39 of the pedal 38 placed therebetween are in contact with a lower surface of either the receiving edge 40*a* or 40*b* (lower receiving edge 40*b* in the illustrated example).

A transmission rod 42 is inserted into the pivot shaft 40 at an area below that portion of the pivot shaft 28 on which the transmission sleeve 40 is mounted. The transmission sleeve 40 and the transmission rod 42 are connected to each other by a connector element 43 through which a vertically extending groove 28*a* formed in the pivot shaft 28 is allowed to extend.

A lower end of the transmission rod 42 projects inwardly of the bearing base 33 and is connected to one end of a wire member 44 formed of a chain. The other end of the wire member 44 is connected to a top wall of the bearing base 33 through a return spring 45 formed of a tension coil spring. The wire member 44 is wound on a pulley 46 formed of a chain wheel which is rotatably supported by the drive shaft 34. The pulley 46 is connected to the drive shaft 34 through a one-way clutch 47 adapted to transmit only one-way rotation to the drive wheel 30.

The above-mentioned pedal 38, transmission sleeve 40, transmission rod 42, wire member 44, pulley 46 and one-way clutch 47 constitute the drive mechanism 36. When the worker on the scaffolding platform 23 steps on the pedal 38, the roller 41 causes the transmission sleeve 40 to move upwardly. Then, the transmission rod 42, which is moved up and down in unison with the transmission sleeve 40, pulls the wire member 44 to rotate the pulley 46 by an angle corresponding to its moved distance. Rotation of the pulley 46 caused by the worker's actuation of the pedal 38 is transmitted to the drive shaft 34 and the drive wheel 30 through the one-way clutch 47, to thereby move the scaffold 1. When the pedal 38 is released, the wire member 44, the transmission rod 42 and the transmission sleeve 40 are pulled back under the effect of the return spring 45. Reverse rotation of the pulley 46 at that time is not transmitted to the drive shaft 34.

Accordingly, by stepping on the pedal 38 repeatedly, the scaffold 1 is gradually moved, and by turning the handle 29 to rotate the pivot shaft 28, the transmission sleeve 40, the transmission rod 42, the holding sleeve 32 and the bearing base 33 are turned in unison to change the direction of the drive wheel 30. Since the rollers 41 are normally in contact with the flange-like receiving edges 40*a* and 40*b*, the direction of the scaffold 1 can freely be changed while stepping on the pedal 38.

Since the scaffold 1 has a pair of front wheels 10 and a pair of rear wheels 19 at four corners thereof, it is stable. Moreover, since the large part of load is supported by those front and rear wheels, the drive wheel 30 acts solely for movement. However, since a force acts on the drive mechanism 36 in a direction for lifting up when the pedal 38 is stepped down, there is a fear that wear moment of the drive wheel 30 is reduced to rotate the drive wheel idly. In this embodiment, therefore, there is provided a load application mechanism 49 comprising a depression spring 50 formed of a compression coil spring surrounding the guide sleeve 31 is interposed between a spring retainer 32*a* mounted on an upper end of the holding sleeve 32 and the intermediate lid plate 26*c* so that a downward force is applied to the pivot shaft 28 and the bearing base 33 in order to bring the drive wheel 30 into contact with the bearing table 33 under appropriate pressure. By virtue of a provision of this load application mechanism 49, the drive wheel 30 can positively move the scaffold 1 without being rotated idly.

Next, since the scaffold 1 is supported merely by the wheels, there is a possibility that the scaffold is accidentally moved by force of the worker's feet loaded thereon when the worker is engaged in work during the stop of the scaffold. As a counter-measure for this, the scaffold 1 is equipped with a scaffold stationarily holding mechanism 52.

Figure 4:
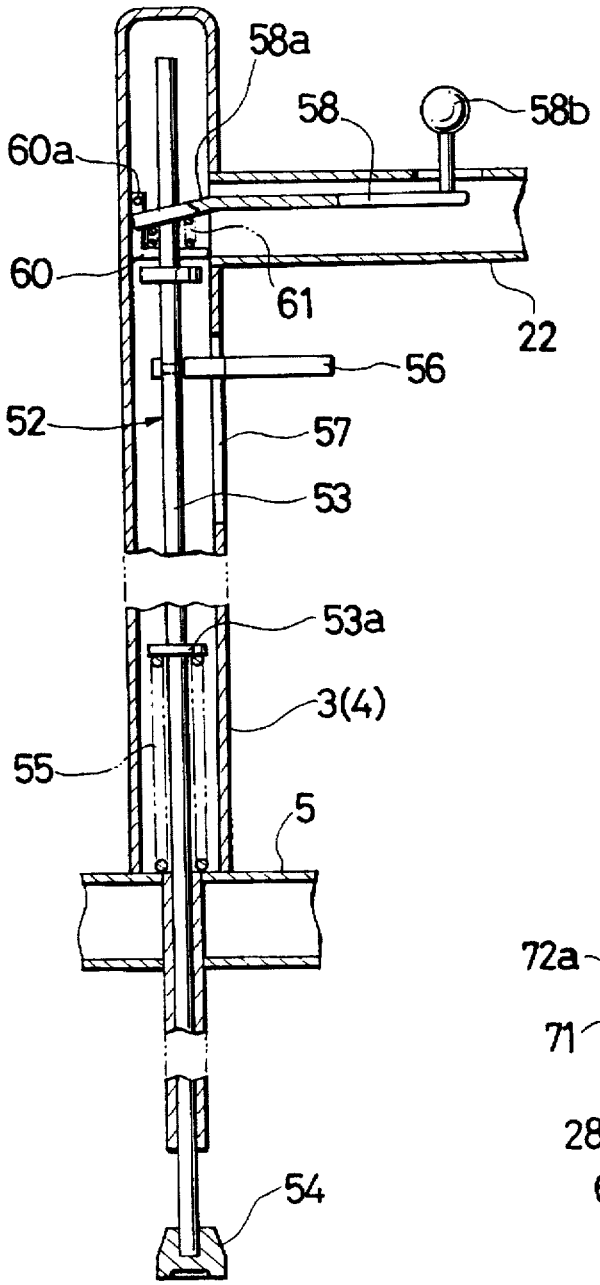
FIG. 4 is a partly vertically sectional view showing a scaffold stationarily holding mechanism.

Referring chiefly to FIGS. 2 and 4, a lifting rod 53 is inserted in each of the pair of support posts 3 and 4 of the front frame 2. A lower end of the lifting rod 53 projects downwardly of the support post 3 (or 4) to allow a stepping member 54, which is made of elastic material such as synthetic resin, to be mounted thereon.

A lifting force for bringing the stepping member 54 apart from the floor surface is applied to the lifting rod 53 by a lifting spring 55 formed of a compression coil spring received between a spring retainer 53*a* at a location in the vicinity of a lower end of the lifting rod 53. Also, at a location in the vicinity of an upper end of the lifting rod 53, a rod-like press-down lever 56 is provided. This press-down lever 56 is allowed to project from a vertically extending window opening 57 formed in a rear surface of the support rod 3 (or 4). Arranged at a location slightly above the press-down lever 56 is a release lever 58. A bending distal end portion 58*a* of the release lever 58 is received in the lifting rod 53. Furthermore, a lock spring 61 formed of a compression coil spring is disposed between a receiving seat 60 extending through the lifting rod 53 in the support post 3 (or 4) and the bending distal end portion 58*a*. Under the effect of the lock spring 61, a foremost end of the bending distal end portion 58*a* is brought into abutment with a locking edge 60*a* of the receiving seat 60. As a result, an inner peripheral edge of the bending distal end portion 58*a* is caused to be inclined relative to the axis of the lifting rod 53, thus allowing the bending distal end portion 58*a* to intimately engage the lifting rod 53.

The release lever 58 extends into the hand rail 22 from the support post 3 (or 4). A grip portion 58*b* formed on a basal end of the release lever 58 projects upwardly of the hand rail 22. In operation, this grip portion 58*b* is pressed down to turn the release lever 58 about its area of contact with the locking edge 60*a* to bring the bending distal end portion 58*a* into a position generally right angle relative to the axis of the lifting rod 53, so that a space is formed therebetween. In that state, the press-down lever 56 is depressed against the force of the lifting spring 55 to lift down the lifting rod 53 until the stepping member 54 contacts the floor surface under pressure, thereby releasing the release lever 58. By doing this, the lifting rod 53 is fixed to a lifted-down position by a peripheral edge of a lock hole 59 biting therein, and the movement of the front wheels 10 formed of casters is prohibited by the stepping member 54 which is in contact with the floor surface under pressure. As a result, the fear for accidentally moving the scaffold 1 during the stop of the scaffold can be obviated. When the grip portion 58*b* of the release lever 58 is pressed down, the lifting rod 53 is lifted up under the effect of the lifting spring 55 and as a result, the stepping member 54 is brought apart from the floor surface.

The above-mentioned lifting rod 53, stepping member 54, lifting spring 55, release lever 58, locking edge 60*a* and lock spring 61 constitute the scaffold stationarily holding mechanism 52.

It should be noted that the embodiments so far described have the advantages that by repeated stepping-on operation of the pedal 38 and manipulation of the handle 29 performed by the worker who rides on the scaffolding platform 23, the scaffold 1 can be moved in any desired direction in a stable fashion and without a need of much labor; by stationarily holding the scaffold 1, the worker can engage in work at a predetermined position without worrying about a possibility of accidental movement of the scaffold; and a workable range or area in the sense of height can be increased. In this embodiment, a mechanism for enhancing movability of the scaffold 1 is employed in addition to the foregoing features.

Specifically, there is provided, firstly, a front wheel raising mechanism 63 for depressing the drive wheel 30 into a position lower than the front wheels 10 in order to facilitate a smooth movement on an upward slope.

Figure 5:
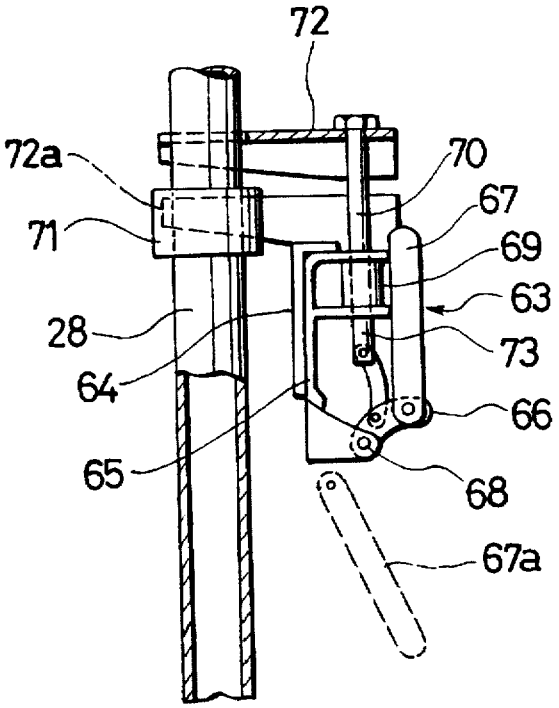
FIG. 5 is a side view, partly cut-away, of a front wheel raising mechanism.

Referring to FIGS. 2 and 5, the front wheel raising mechanism 63 comprises a mounting base 64 fixedly disposed at a higher location within the cover member 26 of the front frame 2, a bearing base 64 secured to the mounting base 64, a control lever 66 having a handle 67 turnably supported on the bearing base 65 through a pin 68, a guide sleeve 69 provided on the bearing base 65, a thrust shaft 70 slidably extending through and supported by the guide sleeve 69, a flange-like receiving edge 71 provided on the pivot shaft 28, a plate-like thrust element 72 having a forked end engagably contacting the flange-like receiving edge 71 and firmly secured to one end of the thrust shaft 70, and a link 73 through which the other end of the thrust shaft 70 is mutually turnably connected to the control lever 66.

The thrust shaft 70 is arranged in parallel relation with the pivot shaft 28. The thrust element 72 is in a location slightly away from and upwardly of the receiving edge 71. When the worker riding on the scaffolding platform 23 inserts the hand into the cover member 26 from the back thereof and pulls the handle 67 downwardly while turning the handle, the control lever 66 is turned clockwise in the drawing about the pin 68. By this, the thrust shaft 70 is pulled downwardly to allow the thrust element 72 to push the receiving edge 71, so that the pivot shaft 28, the holding sleeve 32 and the bearing base 33 are pushed down in unison. As a result, the drive wheel 30 is depressed into a position slightly lower than the front wheels 10, and the scaffold 1 is supported at three spots by the pair of rear wheels 19 and the drive wheel 30. The front wheels 10 are raised slight from the floor surface.

In this embodiment, the handle 67 is pulled to a position indicated by a two-dotted chain line 67*a* to lower the thrust element 72 to a position indicated likewise by a two-dotted chain line 72*a*. Since the control lever 66 is turned exceeding a dead point pulling the link 73, an upward movement of the pivot shaft 28 is prohibited by reaction of the load supported on the drive wheel 30.

In this way, by relatively raising the front wheels 10, the scaffold 1 can smoothly move from a horizontal floor surface to an upwardly inclined floor surface. By raising the front wheels 10 on the slope where the wheels 10 formed of casters tends to be unstable in direction, the scaffold 1 can be moved in a predetermined direction in a stable fashion. It should be noted that by pulling the handle 67 while turning it in an opposite direction, the thrust element 72 is moved upwardly and the pivot shaft 28 and the drive mechanism 36 are returned to the positions of predetermined heights.

As a second mechanism for enhancing the movability of the scaffold 1, there is provided a rear wheel braking mechanism 75 which is designed for providing a braking force to the rear wheels 19 in order to enhance the stability and safety on the downward slope.

Figure 6:
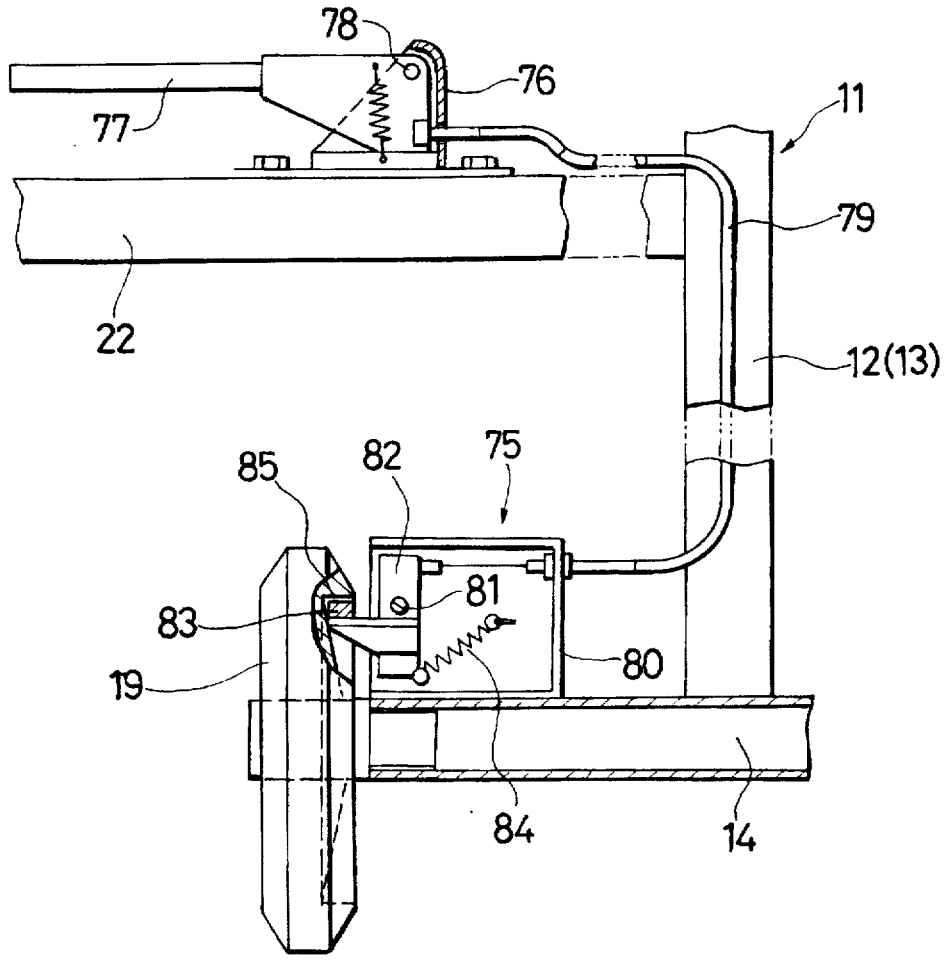
FIG. 6 is a view, partly cut-away, of a rear wheel braking mechanism.

Reference is made to FIG. 6. This rear wheel braking mechanism 75 comprises a handle receiving seat 76 fixedly mounted on an upper surface of the hand rail 22, a braking lever 77 turnably supported by the handle receiving seat 76 through a pin 78 and a wire 79. The wire 79 is connected at one end to one end of the braking lever 77 and is disposed along the hand rail 22, the support post 12 (or 13) and the lower crossbeam member 14 to a cover box 80. The cover box 80 is fixedly mounted on an upper surface of the lower crossbeam member 14. A shoe holding member 82 is turnably supported within the cover box 80 through a pin 81. The other end of the wire 79 is connected to the shoe holding member 82 and the shoe holding member 82 is provided with a shoe 83 contactable with a inwardly facing ring surface 85 of the rear wheel 19. A release spring 84 formed of a tension coil spring is disposed between the cover box 80 and the shoe holding member 82.

The braking lever 77 is in parallel relation with the hand rail 22 when the braking lever is not in operation. When the braking lever 77 is turned clockwise in FIG. 6 about the pin 78, the wire 79 is pulled to turn the shoe holding member 82 against the force of the release spring 84, so that the shoe 83 is urged against the ring surface 85 to apply a braking force to the rear wheel 19.

In this way, by braking the rear wheels 19, it becomes possible for the worker to limit the speed of the scaffold 1 when the scaffold moves on a downwardly inclined floor surface. As a result, the scaffold 1 can be moved safely and free from the fear of collision and falling-down due to accidental movement of the scaffold.

As a third mechanism for enhancing the movability of the scaffold 1, there is provided a drive wheel raising mechanism 86 for raising the drive wheel 30 to a position higher than the front wheels 10 so that the scaffold 1 can be easily moved by hand-push when the scaffold is not in the working site.

The construction of this drive wheel raising mechanism 86 is the same to that of the front wheel raising mechanism 63 but the operation is performed in a vertically reversed way. Specifically, referring to FIGS. 2 and 7, the drive wheel raising mechanism 86 comprises a mounting base 87 fixedly disposed at a lower location within the cover member 26 of the front frame 2, a bearing base 88 secured to the mounting base 87, a control lever 89 having a handle 90 turnably supported on the bearing base 88 through a pin 91, a guide sleeve 92 provided on the bearing base 88, a thrust shaft 93 slidably extending through and supported by the guide sleeve 92, a flange-like receiving edge 94 provided on the pivot shaft 28, a plate-like thrust element 95 having a forked end engagably contacting the flange-like receiving edge 94 and firmly secured to one end of the thrust shaft 93, and a link 96 through which the other end of the thrust shaft 93 is mutually turnably connected to the control lever 89.

The thrust shaft 93 is arranged in parallel relation with the holding sleeve 32. The thrust element 95 is in a location slightly away from and downwardly of the receiving edge 94. When the worker standing on the floor surface inserts the hand into the cover member 26 from the back thereof and pulls the handle 90 upwardly while turning the handle, the control lever 89 is turned counterclockwise in the drawing about the pin 91. By this, the thrust shaft 93 is pulled upwardly to allow the thrust element 95 to lift up the receiving edge 94, so that the holding sleeve 32, the bearing base 33 and the pivot shaft 28 are lifted up in unison. As a result, the drive wheel 30 is raised into a position slightly higher than the front wheels 10, and the scaffold 1 is supported at four spots by the pair of front wheels 10 and the pair of rear wheels 19.

Figure 7:
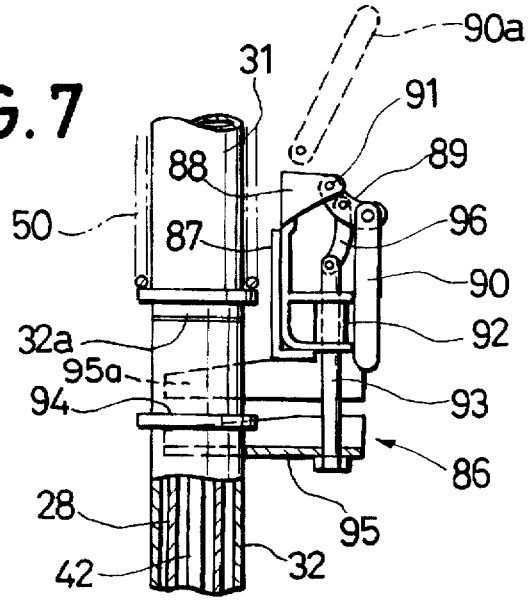
FIG. 7 is a side view, partly cut-away, showing a drive wheel raising mechanism.
Figure 8:
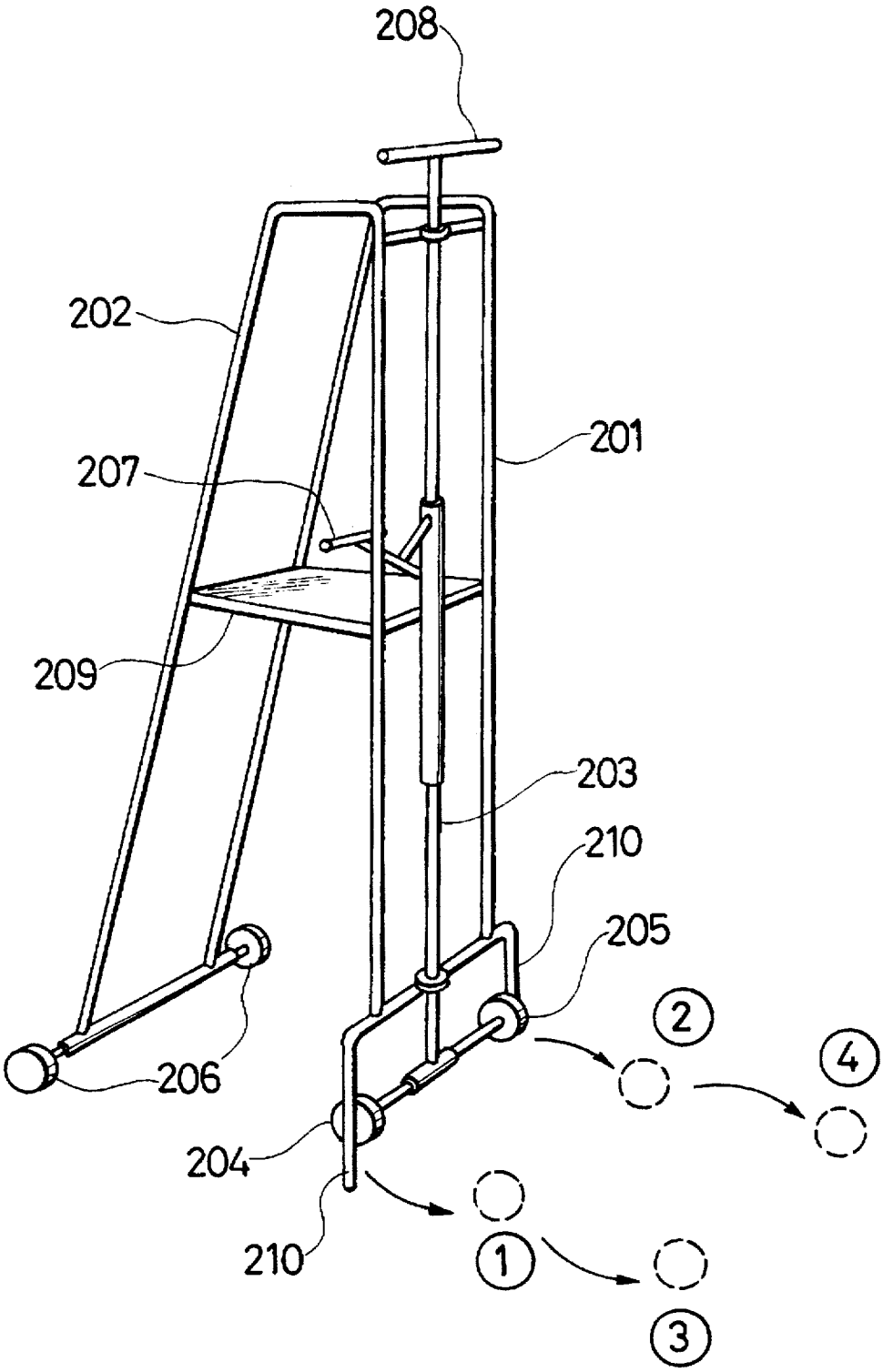
FIG. 8 PRIOR ART
FIG. 8 is a schematic perspective view of the Prior Art.

Also in this embodiment, the handle 90 is pulled up into a position indicated by a two-dotted chain line 90*a* in FIG. 7 to lift up the thrust element 95 into a position indicated likewise by a two-dotted chain line 95*a*. Since the control lever 89 is turned exceeding a dead point pulling the link 96, the pivot shaft 28 and the drive mechanism 36 are prevented from dropping by dead weight thereof.

In this way, by raising the drive wheel 30, when the worker moves the scaffold 1 by hand-push without riding on the scaffolding platform 23, there is encountered with no such inconvenience that the turnable drive wheel 30 and the pair of likewise turnable front wheels 10 are mutually faced with different directions to make it impossible for the scaffold 1 to move. As a result, the scaffold 1 can be easily and reliably brought into and out of the working site. It should be noted that by pulling the handle 90 in the opposite direction while turning the handle, the thrust element 95 is moved downwardly and the pivot shaft 28 and the drive mechanism 36 are return to positions of predetermined heights.

In the illustrated embodiment, since the steering mechanism 27 and the drive mechanism 36 are mounted on the cover member 26 which is removably mounted on the front frame 2, there is such advantage that the assembling, adjustment, inspection and repairing operation of one of, some of or all of those mechanisms can be performed at any desired place by removing them from the scaffold 1. For this purpose, there may be provided a catching mechanism (not shown) for receiving the pedal 38 in the cover member 26 in its upright posture. As for the means for removably mounting the cover member 26 on the front frame 2, any appropriate, known devices, such as screws and latches can be used. Alternatively, it may be designed that the steering mechanism 27 and the drive mechanism 36 are mounted directly on the front frame 2 and not covered with the cover member 26.

As apparent from the foregoing description, according to the present invention, since the scaffold supported on the four front and rear wheels is turned through repeated stepping-on operation of the pedal for rotating the drive wheel and manipulation of the handle for changing the direction of the drive wheel all made by the worker riding on the scaffolding platform, even a large-sized scaffold, on which two or more workers are loaded together with other loads, can be moved in any desired direction in a stable fashion and without a need of much labor. With this scaffold, the worker can engage in a work at a higher location while gradually moving the scaffold and without getting enormous fatigue.

Furthermore, by stationarily holding the scaffold, the worker can perform the work safely in a stable fashion. Also, by properly adjusting the height of the scaffolding platform, the workable range or area in the sense of height can be increased. As a result, the movable working scaffold of the present invention can be widely used for various purposes.

Although this invention has been described in its preferred form with a certain degree of particularity, it is understood that the present disclosure of the preferred form has been made only by way of example and that numerous changes in the details of construction and arrangement of parts may be resorted to without departing from the spirit and the scope of the invention as hereinafter claimed.

What is claimed is:

1. A movable working platform comprising:

a scaffold including a front frame having a pair of support posts, and a pair of front wheels mounted on opposite sides of a lower end of said front frame, a rear frame having a pair of support posts, and a pair of rear wheels mounted on opposite sides of a lower end of said rear frame, and a scaffolding platform disposed between said front and rear frames;

a steering mechanism including a steering shaft vertically arranged along said front frame, a handle mounted on an upper end of said steering shaft, and a drive wheel mounted on a lower end of said steering shaft;

a foot-actuated drive mechanism including a foot-actuated pedal pivotally supported by said front frame proximate to the scaffolding platform, a wire member wound on a pulley and reciprocally moved in response to a reciprocating pivoting motion of said pedal, and a one-way clutch for transmitting only a one-way rotation of said pulley to said drive wheel in order to propel the working platform;

means for adjusting a vertical mounting position of said scaffolding platform between said front and rear frames; and means for adjusting a vertical mounting position of said pedal.

2. The movable working platform as defined in claim 1, further comprising a scaffold stationarily holding mechanism including a stepping member vertically movably arranged along said front frame, and means for fixing said stepping member at a desired height.

3. The movable working platform as defined in claim 1 or 2, further comprising a rear wheel braking mechanism including a braking lever mounted on said scaffold, a shoe to be contacted, under pressure, with a ring face formed on each of said rear wheels, and a wire extending along said scaffold and adapted to operatively connect said braking lever to said shoe.

4. The movable working platform as defined in claim 1 or 2, in which said steering mechanism includes a drive wheel raising mechanism for lifting up said drive wheel so as to retain said drive wheel in a higher position than said front wheels.

5. The movable working platform as defined in claim 1, in which said steering mechanism includes a front wheel raising mechanism for raising said front wheels so as to retain said drive wheel in a lower position than said front wheels.

6. The movable working platform as defined in claim 1, further comprising a rear wheel braking mechanism including a braking ever mounted on said scaffold, a shoe to be contacted, under pressure, with a ring face formed on each of said rear wheels, and a wire extending along said scaffold and adapted to operatively connect said braking lever to said shoe.

7. The movable working platform as defined in claim 1, in which said steering mechanism includes a drive wheel raising mechanism for lifting up said drive wheel so as to retain said drive wheel in a higher position than said front wheels.

8. The movable working platform as defined in claim 1, wherein the pedal of the drive mechanism is pivotable about a generally horizontal axis which is located proximate to the steering shaft of the steering mechanism.

9. A movable working platform comprising:

a scaffold including a front frame having a pair of support posts, and a pair of front wheels mounted on opposite sides of a lower end of said front frame, a rear frame having a pair of support posts, and a pair of rear wheels mounted on opposite sides of a lower end of said rear frame, and a scaffolding platform disposed between said front and rear frames;

a steering mechanism including a steering shaft vertically arranged along said front frame, a handle mounted on an upper end of said steering shaft, and a drive wheel mounted on a lower end of said steering shaft;

a drive mechanism including a pedal swingably supported by said front frame, a wire member wound on a pulley and reciprocally moved in response to a swinging motion of said pedal, and a one-way clutch for transmitting only a one-way rotation of said pulley to said drive wheel; and means for adjusting a vertical mounting position of said scaffolding platform between said front and rear frames, and means for adjusting a vertical mounting position of said pedal.

10. The movable working platform as defined in claim 9, further comprising a scaffold stationarily holding mechanism including a stepping member vertically movably arranged along said front frame, and means for fixing said stepping member at a desired height.

11. The movable working platform as defined in claim 9, in which said steering mechanism includes a front wheel raising mechanism for raising said front wheel so as to retain said drive wheel in a lower position than said front wheels.

12. The movable working platform as defined in claim 9, further comprising a rear wheel braking mechanism including a braking lever mounted on said scaffold, a shoe to be contacted, under pressure, with a ring face formed on each of said rear wheels, and a wire extending along said scaffold and adapted to operatively connect said braking lever to said shoe.

13. The movable working platform as defined in claim 9, in which said steering mechanism includes a drive wheel raising mechanism for lifting up said drive wheel so as to retain said drive wheel in a higher position than said front wheels.

14. A movable working platform comprising:

a scaffold including a front frame having a pair of support posts, and a pair of front wheels mounted on opposite sides of a lower end of said front frame, a rear frame having a pair of support posts, and a pair of rear wheels mounted on opposite sides of a lower end of said rear frame, and a scaffolding platform disposed between said front and rear frames;

a steering mechanism including a steering shaft vertically arranged along said front frame, a handle mounted on an upper end of said steering shaft, and a drive wheel mounted on a lower end of said steering shaft;

a drive mechanism including a pedal swingably supported by said front frame, a wire member wound on a pulley and reciprocally moved in response to a swinging motion of said pedal, and a one-way clutch for transmitting only a one-way rotation of said pulley to said drive wheel; and said steering mechanism further includes a front wheel raising mechanism for raising said front wheels so as to retain said drive wheel in a lower position than said front wheels.

15. The movable working platform as defined in claim 14, further comprising a scaffold stationarily holding mechanism including a stepping member vertically movably arranged along said front frame, and means for fixing said stepping member at a desired height.

16. The movable working platform as defined in claim 14, further comprising means for adjusting a vertical mounting position of said scaffolding platform between said front and rear frames, and means for adjusting a vertical mounting position of said pedal.

17. The movable working platform as defined in claim 14, further comprising a rear wheel braking mechanism including a braking lever mounted on said scaffold, a shoe to be contacted, under pressure, with a ring face formed on each of said rear wheels, and a wire extending along said scaffold and adapted to operatively connect said braking lever to said shoe.

18. The movable working platform as defined in claim 14, in which said steering mechanism includes a drive wheel raising mechanism for lifting up said drive wheel so as to retain said drive wheel in a higher position than said front wheels.

19. A movable working platform comprising:

a scaffold including a front frame having a pair of support posts, and a pair of front wheels mounted on opposite sides of a lower end of said front frame, a rear frame having a pair of support posts, and a pair of rear wheels mounted on opposite sides of a lower end of said rear frame, and a scaffolding platform disposed between said front and rear frames;

a steering mechanism including a steering shaft vertically arranged along said front frame, a handle mounted on an upper end of said steering shaft, and a drive wheel mounted on a lower end of said steering shaft; and a foot-actuated drive mechanism including a foot-actuated pedal pivotally supported by said front frame proximate to the scaffolding platform, a wire member wound on a pulley and reciprocally moved in response to a reciprocating pivoting motion of said pedal, and a one-way clutch for transmitting only a one-way rotation of said pulley to said drive wheel in order to propel the working platform, the steering mechanism including a front wheel raising mechanism for raising the front wheels so as to retain said drive wheel in a lower position than said front wheels.

20. The movable working platform as defined in claim 19, further comprising a scaffold stationarily holding mechanism including a stepping member vertically movably arranged along said front frame, and means for fixing said stepping member at a desired height.

21. The movable working platform as defined in claim 19, further comprising means for adjusting a vertical mounting position of said scaffolding platform between said front and rear frames, and means for adjusting a vertical mounting position of said pedal.

22. The movable working platform as defined in claim 19, further comprising a rear wheel braking mechanism including a braking lever mounted on said scaffold, a shoe to be contacted, under pressure, with a ring face formed on each of said rear wheels, and a wire extending along said scaffold and adapted to operatively connect said braking lever to said shoe.

23. The movable working platform as defined in claim 19, in which said steering mechanism includes a drive wheel raising mechanism for lifting up said drive wheel so as to retain said drive wheel in a higher position than said front wheels.

* * * * *